US008206125B2

(12) United States Patent
Kuttler et al.

(10) Patent No.: US 8,206,125 B2
(45) Date of Patent: Jun. 26, 2012

(54) OPERATING METHOD FOR FLUID WORKING MACHINE

(75) Inventors: Onno Kuttler, Dalkeith (GB); Ken Kin-ho Lai, Edinburgh (GB)

(73) Assignees: Sauer-Danfoss ApS, Nordborg (DK); Artemis Intelligent Power Ltd., Midlothian, Scotland (GB)

( * ) Notice: Subject to any disclaimer, the term of this patent is extended or adjusted under 35 U.S.C. 154(b) by 0 days.

(21) Appl. No.: 12/740,798

(22) PCT Filed: Oct. 29, 2008

(86) PCT No.: PCT/DK2008/000381

§ 371 (c)(1), (2), (4) Date: Aug. 12, 2010

(87) PCT Pub. No.: WO2009/056137

PCT Pub. Date: May 7, 2009

(65) Prior Publication Data

US 2010/0303657 A1 Dec. 2, 2010

(30) Foreign Application Priority Data

Nov. 1, 2007 (EP) ..... 07254337

(51) Int. Cl.
*F04B 49/22* (2006.01)
*F04B 7/00* (2006.01)
*F04B 39/08* (2006.01)

(52) U.S. Cl. ..... 417/53; 417/505

(58) Field of Classification Search ..... 417/53, 417/505, 290, 270, 278, 297, 315, 349, 506; 60/445; 251/129.01, 129.05, 129.08
See application file for complete search history.

(56) References Cited

U.S. PATENT DOCUMENTS

| | | | |
|---|---|---|---|
| 4,321,014 | A | 3/1982 | Eburn, Jr. et al. |
| 4,815,946 | A | 3/1989 | Cusack |
| 5,046,926 | A | 9/1991 | Deininger et al. |
| 5,186,612 | A | 2/1993 | Budzich |
| 5,190,446 | A | 3/1993 | Salter et al. |
| 5,921,759 | A | 7/1999 | Khan |
| 6,055,851 | A | 5/2000 | Tanaka et al. |
| 6,126,418 | A | 10/2000 | Sinnl |
| 6,283,724 | B1 | 9/2001 | Alaze et al. |
| 6,681,571 | B2 | 1/2004 | Bailey et al. |
| 2004/0105763 | A1 | 6/2004 | Kondo |
| 2006/0039795 | A1 | 2/2006 | Stein et al. |

(Continued)

FOREIGN PATENT DOCUMENTS

| | | |
|---|---|---|
| DE | 4306377 | 9/1994 |

(Continued)

OTHER PUBLICATIONS

International Search Report dated Feb. 2, 2009 from Serial No. PCT/DK2008/000381.

(Continued)

*Primary Examiner* — Toan Ton
*Assistant Examiner* — Elmito Breval
(74) *Attorney, Agent, or Firm* — McCormick, Paulding & Huber LLP

(57) ABSTRACT

A fluid working machine (1) has several working chambers (5) of cyclically changing volume. For pumping hydraulic fluid, the inlet and outlet valves (8, 9) are electrically actuated. The timing of the actuation of said electrically actuated valves (8, 9) is varied depending on the fluid flow demand.

17 Claims, 7 Drawing Sheets

U.S. PATENT DOCUMENTS

| | | | |
|---|---|---|---|
| 2009/0120086 | A1 | 5/2009 | Kuttler et al. |

FOREIGN PATENT DOCUMENTS

| | | | |
|---|---|---|---|
| EP | 0361927 | A1 | 4/1990 |
| EP | 0494236 | | 7/1992 |
| EP | 0577783 | | 1/1994 |
| EP | 1319836 | A2 | 6/2003 |
| EP | 1469237 | A1 | 10/2004 |
| EP | 1537333 | | 6/2005 |
| EP | 2055943 | A1 | 6/2009 |
| EP | 2055944 | A1 | 6/2009 |
| EP | 2055945 | A1 | 6/2009 |
| EP | 2055946 | A1 | 6/2009 |
| GB | 968452 | | 9/1964 |
| GB | 1374752 | | 11/1974 |
| WO | 9105163 | A1 | 4/1991 |
| WO | 2004025122 | A1 | 3/2004 |

OTHER PUBLICATIONS

International Search Report dated Feb. 2, 2009 from Serial No. PCT/DK2008/000385.

International Search Report dated Feb. 2, 2009 from Serial No. PCT/DK2008/000382.

International Search Report dated Feb. 2, 2009 from Serial No. PCT/DK2008/000386.

International Search Report dated Feb. 2, 2009 from Serial No. PCT/DK2008/000384.

OPERATING METHOD FOR FLUID WORKING MACHINE

CROSS REFERENCE TO RELATED APPLICATIONS

This application is entitled to the benefit of and incorporates by reference essential subject matter disclosed in International Patent Application No. PCT/DK2008/000381 filed on Oct. 29, 2008 and EP Patent Application No. 07254337.4 filed Nov. 1, 2007.

FIELD OF THE INVENTION

The invention relates to a method of operating a fluid working machine, comprising at least one working chamber of cyclically changing volume, a high pressure fluid connection, a low pressure fluid connection and at least one electrically actuated valve, connecting said working chamber to said high pressure fluid connection and/or said low pressure fluid connection. The invention further relates to a fluid working machine, comprising at least one working chamber of cyclically changing volume, a high pressure fluid connection, a low pressure fluid connection, at least one electrically actuated valve, connecting said working chamber to said high pressure fluid connection and/or said low pressure fluid connection and at least one electronic controller unit.

BACKGROUND OF THE INVENTION

Such fluid working machines are generally used, when fluids are pumped or a fluid is generating a mechanical movement. The word "fluid" can relate to both gases and liquids. Of course, the word "fluid" can even relate to a mixture of gas and liquid and furthermore to a supercritical fluid, where no distinction between gas and liquid can be made anymore.

In particular, such fluid working machines are used, if the pressure level of a fluid has to be increased. For example, such a fluid working machine could be an air compressor or a hydraulic pump.

Generally speaking, fluid working machines comprise one or more working chambers of a cyclically changing volume. Usually, for each cyclically changing volume, there is provided a fluid inlet valve and a fluid outlet valve.

Traditionally, the fluid inlet valves and the fluid outlet valves are passive valves. When the volume of a certain working chamber increases, its fluid inlet valve opens, while its fluid outlet valve closes, due to the pressure differences, caused by the volume increase of the working chamber. When the volume of the working chamber decreases again, the fluid inlet valve closes, while the fluid outlet valve opens due to the changed pressure differences.

A relatively new and promising approach for improving fluid working machines are the so-called "synthetically commutated hydraulic pumps", also known as "digital displacement pumps". Such pumps are a subset of variable displacement pumps. Such synthetically commutated hydraulic pumps are known, for example, from EP 0 494 236 B1 or WO 91/05163 A1. In these pumps, the passive fluid inlet valves are replaced by electrically actuated inlet valves. Preferably the passive fluid outlet valves are also replaced by electrically actuated outlet valves. By appropriately controlling the valves, a full-stroke pumping mode, an empty cycle pumping mode (idle mode) and a part-stroke pumping mode can be achieved. Furthermore, if both inlet and outlet valves are electrically actuated, the pump can be used as a hydraulic motor as well. If the pump is run as a hydraulic motor, full-stroke motoring and part-stroke motoring is possible, as well.

A major advantage of such synthetically commutated hydraulic pumps is their higher efficiency, as compared to traditional hydraulic pumps. Furthermore, because the valves are electrically actuated, the output characteristics of a synthetically commutated hydraulic pump can be changed very quickly.

For adapting the fluid flow output of a synthetically commutated hydraulic pump according to a given demand, several approaches are known in the state of the art.

It is, for example, possible to switch the synthetically commutated hydraulic pump to a full pumping mode for a certain time. When the synthetically commutated hydraulic pump is pumping, a high pressure fluid reservoir is filled. Once a certain pressure level has been reached, the synthetically commutated pump is switched to an idle mode and the fluid flow demand is supplied by the high pressure fluid reservoir. As soon as the high pressure fluid reservoir has reached a certain low pressure threshold, the synthetically commutated hydraulic pump is switched on again.

This approach, however, necessitates a relatively large high pressure fluid reservoir. Such a high pressure fluid reservoir is expensive, occupies a large volume and is quite heavy. Furthermore, a relatively large variation in the output pressure will inevitably occur.

So far, the most advanced proposal for adapting the output fluid flow of a synthetically commutated hydraulic pump according to a given demand is described in EP 1 537 333 B1. Here, it is proposed to use a combination of an idle mode, a part-stroke pumping mode and a full-stroke pumping mode. In the idle mode, no effective pumping is done by the respective working chambers during their working cycle. In the full-stroke mode, all of the usable volume of the working chamber is used for pumping. In the part-stroke mode, only a part of the usable volume is used during the respective working cycle. The different modes are distributed among several chambers and/or several successive cycles in a way, that the time averaged effective flow rate of fluid equals the demand.

In EP 1 537 333 B1, for the part-stroke mode, a certain small fraction of the available volume is chosen. The fraction is chosen beforehand and fixed to a certain number in the controlling unit when the hydraulic pump is operating. This limitation to a certain number has been done for practical purposes: For this number, a calibrating measurement was performed. I. e., for a volume fraction of for example 16%, the actual value of the corresponding actuation angle/firing angle of the fluid inlet valve was determined. The angle has to be established by measurement to get a precise connection between firing angle and fluid flow and thus a precise fluid flow control ability. It has to be noted, that even for hydraulic oil, the compressibility is in the order of a few percent of the total volume at standard hydraulic oil pressures of 300 bars to 500 bars.

While the method, described in EP 1 537 333 B1 is an improvement over previous methods, it still suffers from several drawbacks. For the following examples let's assume that the partial stroke is set to 16%. This number has been chosen by the applicant of EP 1 537 333 B1 for their pumps.

If the fluid flow demand is very low (e.g. 2%) the time interval between two consecutive pumping strokes is still very long even if part-stroke pumping is performed. This can cause a severe pressure pulsation problem. Also, a start-stop ("stiction") effect can be noticed at the load.

A similar problem arises, if the fluid flow demand is slightly above the number of the volume fraction chosen for partial strokes. If the fluid flow demand is for example 17%, the best way to comply with this demand is to use a series of spaced full-stroke pulses. However, the time between two consecutive full-stroke pulses is quite large. This again can cause severe pulsation problems as well as a "stiction"-effect. It should be noted, that there is no advantage, if some part-stroke pulses are performed between two full-stroke pulses. In this case, the time interval between two full-stroke pulses would be even larger.

Another problem occurs, if the fluid flow demand comes close to the full-stroke pumping capacity of the hydraulic fluid pump. Here, a full-stroke will be missing only once in a while. To be exact, the fluid flow will be a series of full-stroke pulses with infrequent, but significant holes of missing full-stroke pulses. This again can cause severe problems with pressure pulsations.

SUMMARY OF THE INVENTION

Therefore, it is the object of the invention to provide a fluid working machine and a method for operating a fluid working machine, causing less problems with fluid flow pulsations.

The problem is solved by modifying a method of operating a fluid machine according to the preamble of claim 1 in a way, that the timing of the actuation of said electrically actuated valve is varied depending on the fluid flow demand. In other words, it is suggested to use an algorithm, where the (main) input parameter is the fluid flow demand and the (main) output parameter is the actuation time (also called actuation angle, firing time or firing angle) of the electrically actuated valve. Hence, the actuation of the electrically actuated valve is varied dynamically, depending on the fluid flow demand. Contrary to the state of the art, no fixed fractional value is used anymore. Admittedly, this may cause the problem that the real fluid flow output can only be approximated from the actuation time. However, the inventors discovered that this is surprisingly not a problem in most applications. If an operator of a hydraulic system asks for a 20% power output by setting the command (for example a throttle, a joy stick, a pedal or the engine speed) to an appropriate position, he will normally not notice, whether the real output is 18, 19, 20, 21 or 22%, for example. Instead, he will automatically correct for this minor difference by re-adjusting the command. However, the functional connection between fluid flow output and command position should be continuous, even if the slope can differ slightly in different ranges of control. I. e., it is preferable, that continuously increasing the command will yield a continual increased fluid flow output without any step-like changes and vice-versa, even if the connection is not necessarily linear.

By discovering, that it is possible to deviate from the existing paradigm, that the functional connection between fluid flow output and actuation time of valves has to be known precisely, it becomes possible to avoid measuring this functional connection for all possible values. Therefore, a variable part-stroke algorithm, as proposed according to an embodiment of the invention, can be realised for the first time for practical applications.

The problem is also solved by modifying a method of operating a fluid machine according to the previously described type in a way, that the actuation of said electrically actuated valve is varied depending on the mechanical power demand. This method is applicable, if the pump is used as a motor, i.e., when the energy, stored in the elevated pressure of the hydraulic fluid is converted by the hydraulic working machine into mechanical energy. Apart from this, the previously mentioned statements are true in a similar way. If in the following description, reference is made only to a pumping fraction, pumping volume, pumping mode and so on, the same will usually apply to a motoring mode of the hydraulic working machine/the hydraulic pump mutatis mutandis. Of course, instead of the mechanical power demand, the flow demand, speed of the fluid working machine, pressure of the hydraulic fluid, temperature of the hydraulic fluid or other parameters can be used as well. Furthermore, a combination of two or more of these parameters (including mechanical power demand, of course), could be used as well.

It is preferred, that at least the pumping/motoring fraction between 0% and 33.3% (one third) of the maximum pumping/motoring volume of said working chamber is chosen. In other words, the electrically actuated inlet valve is closed a relatively short time before the working chamber reaches its minimum volume. In fluid working machines of the piston and cylinder type this would be close to the top dead center. It has been discovered that closing the electrically actuated valve in other regions could lead to increased noise generation and to an increased wear of the electrically actuated valve. This is because of the sinusoidal change of the working chamber's volume in standard type fluid working machines. If the electrically actuated valve is closed in a region of a high change of the working chamber's volume, the speed of the hydraulic fluid entering and/or leaving the working chamber is accordingly high. Of course, it is still possible to actuate the electrically actuated valve outside of the mentioned region, particularly if other modes of noise attenuation an/or hardened valve heads and/or hardened valve seats are used. Furthermore it should be noted, that the mentioned numbers of 0 and 33.3% for the interval limits are not fixed numbers. Instead, also 5%, 10%, 15%, 20%, 25%, 30%, 35% and/or 40% could be used as upper/lower interval limits. In particular, as the upper/lower interval limit ⅓, ¼, ⅕, ⅙, . . .

$$\left(\text{i.e.}\ \frac{1}{N}\ \text{for}\ N = 3, 4, \ldots\right)$$

can be advantageous as well. Of course, the mentioned interval can apply for one, a plurality of or all working chambers and/or for one, a plurality of or all pumping strokes of one, a plurality of or all working chambers.

Another preferred embodiment of the invention can be realised, if at least a pumping/motoring fraction between 66.7% (two thirds) and 100% of the maximum pumping/motoring volume of said working chamber is chosen. Once again, the mentioned numbers are not fixed numbers. Instead, 60%, 65%, 70%, 75%, 80%, 85%, 90% and/or 95% can be chosen as upper/lower interval limits as well. Likewise, ⅔, ¾, ⅘, ⅚, . . .

$$\left(\text{i.e.}\ \frac{N-1}{N}\ \text{for}\ N = 3, 4, \ldots\right)$$

can be advantageous. In other words, the electrically actuated valve will be closed some time after the working chamber has reached its maximum volume and starts to shrink again. In hydraulic fluid working machines of the piston-and-cylinder type, this would be equivalent to a position at or shortly after leaving the bottom dead center. Once again, by selecting this interval, it can be possible to reduce the generated noise and to reduce the wear of the electrically actuated valves. However, it is still possible to vary the fluid-flow output according to the demand with very little pressure variations over a considerably large interval. The mentioned interval can be used for one, a plurality of or all working chambers and/or one, a plurality of or all pumping strokes of one, a plurality of or all working chambers.

Another preferred solution can be obtained, if a pumping/motoring fraction between 33.3% and 66.7% of the maximum pumping motoring volume of said working chamber is excluded. This can be considered as a combination of the previously mentioned embodiments. The objects and advantages of this embodiment are similar to the already mentioned objects and advantages. It is noted, that the already mentioned alternative numbers can be used as well.

Preferably, a plurality of different pumping/motoring fractions of a plurality of working chambers and/or a plurality of different pumping/motoring strokes of at least one working chamber are combined in a way, that the time averaged effective pumping/motoring fraction is adjusted to satisfy the fluid-flow demand. Therefore, the fluid-flow output of several working chambers and/or of several pumping/motoring strokes, presumably some or all of a different value can be combined together in a way, that almost any given demand can be satisfied. Particularly, it is possible to combine several pumping/motoring strokes from different regions in a way, that "forbidden" or undesirable volume fractions in the part-stroke modes are omitted. For example, an alternating 25% part-stroke pulse and a 75% part-stroke pulse will sum up to an effective time average of a 50% part-stroke mode. However, the pressure variations can still be lower as compared to an alternating series of 0% and 100% stroke pulses, as it is done according to the state of the art.

It is possible, that at least one calibration point is used for deriving the pumping/motoring actuation angle(s) from the fluid-flow demand. As already stated, it is not necessary to know the exact functional connection between the fluid-flow output and the actuation time of the electrically actuated valves. However, if one or if several calibration points are provided, the system can be set up in a way, that the value of the fluid outflow of the system can be very close to the value of the demand. Even then, only a very limited set of measurements can be sufficient to set up the limited amount of calibration points.

It is also possible to use a mathematical function for deriving the pumping/motoring actuation angles(s) from the fluid-flow demand. Using this embodiment, it is also possible, to set up the system in a way, that the value of the fluid-flow output is very close to the value of the fluid-flow demand. It is even possible, to set up a mathematical function without any calibration point. However, this does not limit the possibility to use mathematical functions to interpolate between one or several calibration points. Of course, instead of the fluid-flow demand, other input parameters could be used as well, for example pressure of the hydraulic fluid, speed of the hydraulic fluid, temperature of the hydraulic fluid, driving speed of the pump and actual fluid-flow. Of course, a combination of two or more of these parameters (including fluid-flow demand, of course), can be used as well. Instead of a mathematical function (or as a way to implement the mathematical function) a look up table could be used as well. This look up table can be stored in a memory device, e.g. in the electronic controller unit.

The problem is also solved by a fluid-flow machine, comprising at least one working chamber of cyclically changing volume, a high pressure fluid connection, a low pressure fluid connection, at least one electrically actuated valve, connecting said working chamber to said high pressure fluid connection and/or said low pressure fluid connection and at least one electronic controller unit, wherein said electronic controller unit is designed and arranged in a way, that the electronic controller unit actuates said electrically actuated valve according to one or several embodiments of previously described method. If several working chambers are present, a high-pressure fluid manifold and/or a low pressure fluid manifold can be used.

The fluid working machine can be of a type, where only the fluid inlet valves of the working chambers is electrically actuated. Such a fluid working machine should only be used as a pump. Of course it is also possible, that both the inlet and the outlet valves are of the electrically actuated type. Such a fluid working machine could be used as a pump as well as a hydraulic motor. The hydraulic working machine could be of a commonly known piston-and-cylinder type.

BRIEF DESCRIPTION OF THE DRAWINGS

Further details, objects and advantages of the invention will become clear from the following description of preferred embodiments thereof, given together with the enclosed figures. The figures show.

DETAILED DESCRIPTION OF THE PREFERRED EMBODIMENTS

Figure 1:
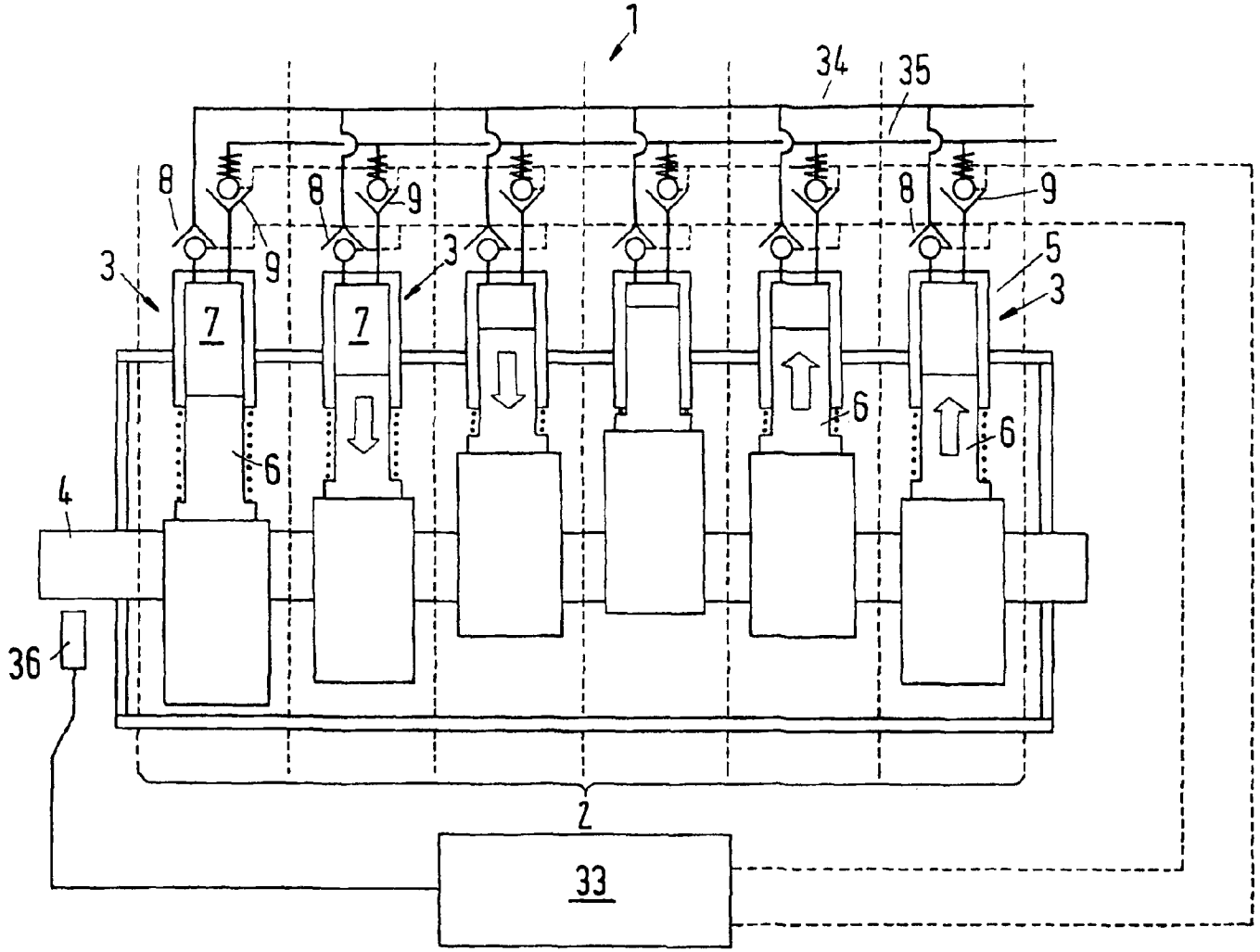
FIG. 1: is a schematic illustration of a synthetically commutated hydraulic pump with a bank of six cylinders.

FIG. 1 shows the schematic overview of a synthetically commutated hydraulic pump, comprising one bank 2 with six cylinders 3. The cylinders 3 are connected to a single rotatable shaft 4, that is common to all cylinders 3. The cylinders 3 are comprising a cylinder portion 5 and a piston 6, each. As it is obvious from FIG. 1, due to the arrangement of the cylinders 3 in a radial direction, each cylinder 3 starts its working cycle at a different time during the rotation of the rotatable shaft 4, i.e. at a different angle of the rotatable shaft 4. In the present example, the six cylinders 3 are arranged at regular intervals. Therefore, the phase difference between two neighbouring cylinders 3 is 60%.

It has to be mentioned, that it is of course possible to use a different number of cylinders 3, i.e. four, five, seven or eight cylinders or any other integer number (it can be even or odd). Also, a different number of cylinder banks 2 may be provided. Furthermore, the cylinders 3 in one or several banks 2 of the synthetically commutated hydraulic pump 1 may be arranged at non-equidistant angles. Moreover, the number of cylinders 3 in different banks 2 of the synthetically commutated hydraulic pump 1 needs not to be the same. For example, one bank 2 might comprise six cylinders 3, while a second bank 2 of the synthetically commutated hydraulic pump 1 comprises just three cylinders 3.

Of course, not only piston-and-cylinder pumps are possible. Instead, other types of pumps can take advantage of the invention as well.

The cylinders 3 have a working chamber 7 of a cyclically changing volume. The working chamber 7 is connected to a low-pressure hydraulic fluid manifold 34 via an electrically actuated inlet valve 8 and to a high-pressure hydraulic fluid manifold 35 via an outlet valve 9, as it is known in the art. In a synthetically commutated pump the outlet valves 9 can be of a passive type (e.g. a spring loaded poppet valve). The outlet valves 9 can also be of an electrically actuated type, as shown in FIG. 1. In the latter case, the synthetically commutated hydraulic pump 1 can be used as a hydraulic motor as well. Of course, if the fluid working machine 1 is used as a hydraulic motor, a valve, which is an inlet valve 8, when the fluid working machine 1 is used as a hydraulic pump, will become an outlet valve, if the fluid working machine is used as a hydraulic motor and vice versa.

The actuation of the electrically actuated valves 8, 9 is done by an electronic controller 33. The main input values for the electronic controller 33 are the shaft's 4 angular position 32 and the current fluid flow demand. The shaft's angular position is measured by an appropriate sensor 36.

Using the shaft's 4 angular position, the position of the piston 6 relative to the cylinder portion 5 of each cylinder 3 can be determined. Of course, it is also possible to determine the shaft's 4 angle 32 from the output of a different sensor. For instance, a position sensor or the like could be used. Using the information about the shaft's 4 angular position 32, the exact timing of the actuation of the electrically commutated valves 8,9 can be determined.

The other main input parameter is the actual fluid flow demand. Depending on the fluid flow demand, opening and closing of the inlet valve 8 is chosen in a way, that the respective cylinder 3 is working in an idle mode, a part-stroke mode or a full-stroke mode. In the idle mode, the inlet valve 8 remains open, so that no effective pumping to the high pressure manifold 35 is performed. In the full stroke mode, the inlet valve 8 is closed at the bottom dead center of the respective cylinder 3. Therefore, the complete usable volume of the respective working chamber 7 is used for pumping.

In the part-stroke mode, the firing angle (actuation time, firing time, actuation angle) of the inlet valve 8 is chosen in a way, that the fraction of the volume of the working chamber 7 which is used for pumping is adapted to and varied with the actual fluid flow demand.

Of course, additional input parameters can be used for the electronic controller 33, as well. For example, pressure information, being indicative of the pressure in the high pressure manifold 35 or the output value of a fluid flow meter can be used. Such information can be used for refining the exact actuation angle of the electrically actuated valves 8.

Figure 2:
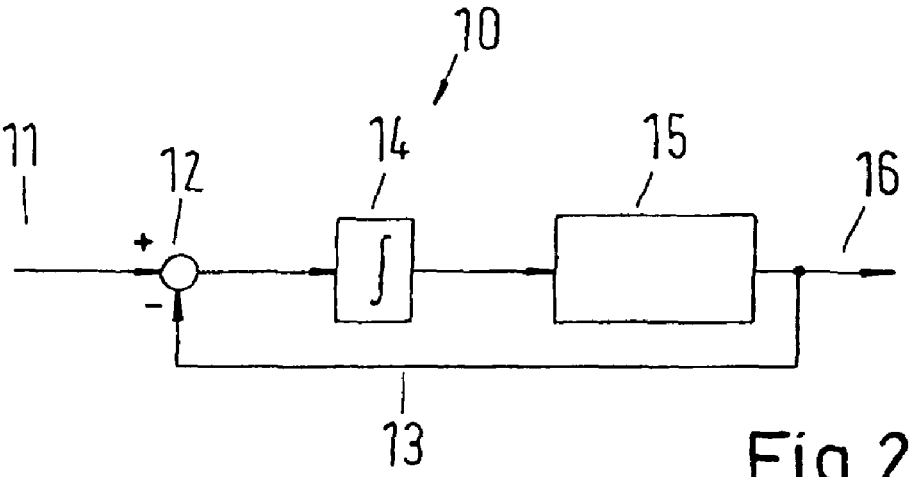
FIG. 2: is a flow diagram of a method for controlling the actuated valves of a synthetically commutated hydraulic pump, depending on the fluid-flow demand.

FIG. 2 shows the principal flow diagram 10 of the electronic controller. The fluid flow demand 11 is input to the accumulator 14 via an adding unit 12. The adding unit 12 also takes into account the actual pumping work, performed by the synthetically commutated pump 1 using a feedback signal 13. The accumulator 14 is a variable, adding up a fluid flow demand 11, which cannot be satisfied by the hydraulic pump 1 at least partially. This could happen, for example, if the fluid flow demand 11 lies within a "forbidden interval", as it will be explained later.

Based on the value of the accumulator 14, the quantisation unit 15 makes a decision about the fraction of the working chamber's volume 7, which has to be used for pumping. Based on this decision, the firing angle of the electrically actuated valves 8, 9 is determined, and an appropriate actuation signal 16 is sent to the electrically actuated valves 8, 9. The connection between the firing angle of the inlet valve 8 and the fraction of the working chamber's 7 volume, that is used for pumping, is illustrated in FIGS. 3 and 4.

Figure 3:
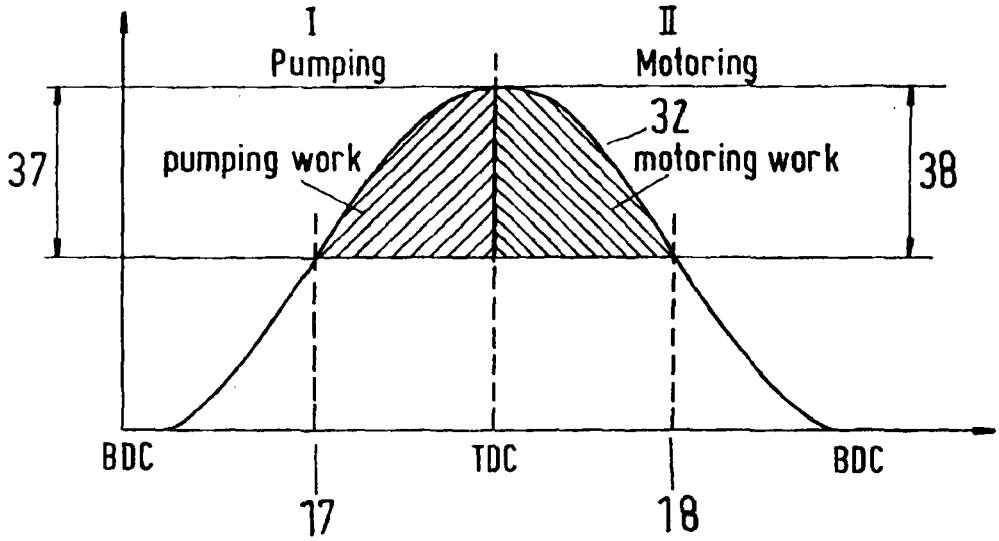
FIG. 3: is a graph, illustrating the connection between firing angle and pumping/motoring volume.
Figure 4:
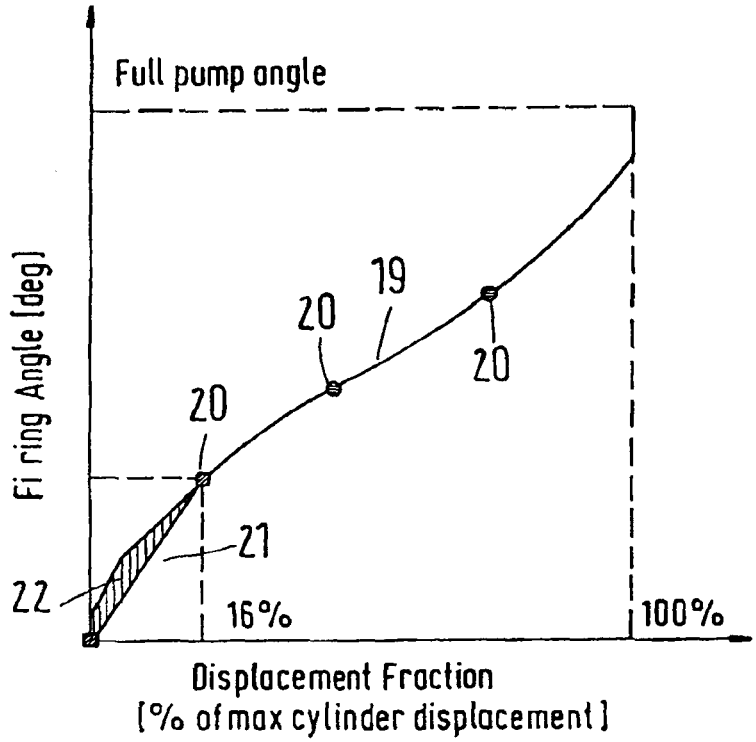
FIG. 4: is a graph, showing the typical functional connection between firing angle and pumping/motoring displacement.

In FIG. 3, the piston's position 32 within the cylinder part 5 is shown over the shaft's angle.

In the pumping region I, the firing angle 17, at which the inlet valve 8 is actuated, lies somewhere between the bottom dead center (BDC) and the top dead center (TDC). If the inlet valve 8 is closed at firing angle 17, only the remaining volume of the working chamber 7 can be used for pumping. This is indicated by the hatched area, whereas the length 37 of the respective area in the direction of the ordinate is proportional (by piston area) to the pumping displacement. As can be seen from FIG. 4, the connection between firing angle 17 and the fractional pumping volume is normally not linear but approximately sinusoidal. In real applications, the curve is even further modified. This is for example due to compressibility effects and dead volumes within the cylinder portions 5 of the cylinders 3 or to the kinematics of the eccentric rotatable shaft 4.

As can be seen from FIG. 3, it is also possible to use the synthetically commutated hydraulic pump 1 in a motoring region II. Here, the valves, which are normally the output valves 9 (i.e. the valves connecting the working chambers 7 to the high pressure fluid manifold) are used as inlet valves and have to be of the electrically actuated type as well. As can be seen from FIG. 3, depending on the firing angle 18, a part of the downward stroke of the piston 6 within the cylinder portion 5 is used for driving the rotable shaft. Once again, the length 38 of the hatched area in the direction of the ordinate is proportional to the motoring displacement.

In real applications the shape of the curve 19, showing the pumping fraction, is normally not known. Although the curve 19 could be determined by measurements in principle, it has to be understood, that the pumping fraction 19 not only depends on the firing angle, but also on different parameters, like the rotation speed of the shaft, the pressure conditions in the high-pressure fluid manifold or the temperature of the hydraulic oil. Therefore, an accordingly large number of measurements would be necessary to measure these conditions for the entire operational range, which is too time-consuming and expensive for practical applications.

However, for practical applications it is not necessary, to know the exact connection between fluid flow demand and actual fluid flow output. This is, because an operator, operating a hydraulic machine, that is driven by the synthetically commutated hydraulic pump 1 will normally not even notice that he gets for example 23, 24, 25, 26 or 27% of the maximum pumping power, if he asks for a 25% fluid flow demand.

Instead, he will automatically correct for the missing or surplus power by adjusting the command appropriately. Of course, the difference between demand and actual output should not be too large. Furthermore, the connection should be continuous. I. e., the operator should receive more power, when he is forwarding the lever, and should receive less power, if he is taking back the lever. Ideally, there should be no noticeable steps or changes in the slope of the function between demand and actual output of the pump. Therefore, the curve 19 should also be continuous and show roughly the same slope in the whole accessible region.

Therefore, for practicable purposes, it is normally sufficient to perform a limited number of measurements, to obtain several calibration points 20 of curve 19. Between the calibration points 20, a linear interpolation 21 can be performed. Of course, this gives rise to an interpolation error 22. The interpolation error 22 can be further decreased by using more calibration points 20 or by using some other types of mathematical function which better approximate the shape of curve 19. Furthermore, some smoothing function could be applied in the vicinity of the calibration points 20 to minimise slope changes in the approximation curve.

Surprisingly, so far it was always assumed, that an exact knowledge of the real fluid flow output of the synthetically commutated hydraulic pump is essential. Therefore, the quantisating unit 15 (see FIG. 2) was set up in a way, that—apart from idle mode and full-stroke mode—only a single volume fraction is allowed as the part-stroke signal 16. For this volume fraction a detailed calibration was done by a measurement, so that an exact calibration point 20 was known. This was suggested in EP 1 537 333 B1.

For real set-ups a volume fraction of 16% was chosen by the applicant of EP 1 537 333 B1.

Therefore, to satisfy a certain demand, a mixture of pumping strokes with 0%, 16% and 100% had to be provided in a way, that on the time average the fluid flow output equalled the demand. However, this method results in both positive and negative pressure spikes which will become clear from the following illustrations of the fluid flow output.

The illustrations are given with respect to a synthetically commutated hydraulic pump 1 as depicted in FIG. 1. I. e., the number of cylinders 3 is 6 and the number of banks 2 is 1. The phases of the six cylinders 3 are equally spaced within a full revolution of the rotatable shaft 4, i.e., 60° out of phase from each other.

Figure 5:
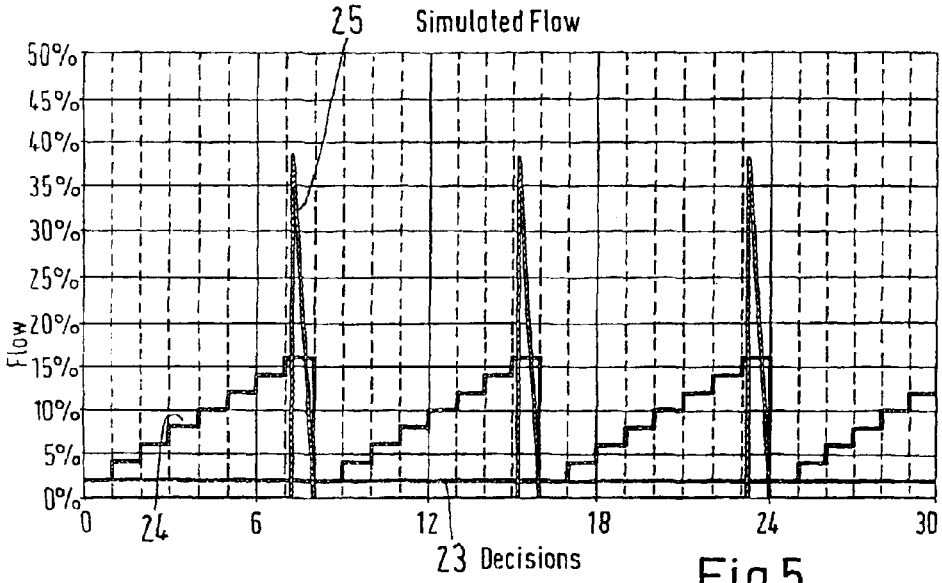
FIG. 5: shows visualisation of the pumping behaviour of a synthetically commutated hydraulic pump according to the state of the art at low fluid flow demands.
Figure 6:
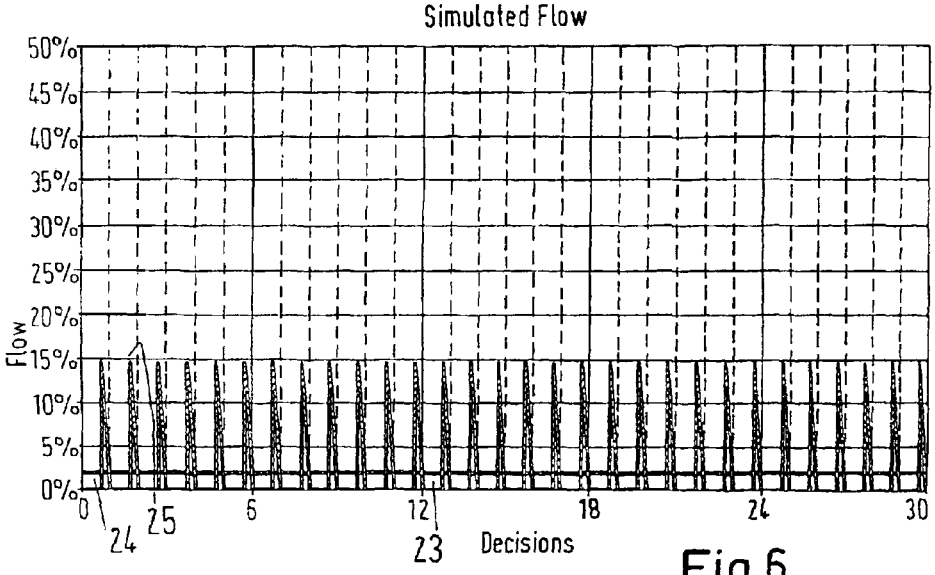
FIG. 6: shows visualisation of the pumping behaviour of a synthetically commutated hydraulic pump using variable part stroke control at low fluid flow demands.

In FIGS. 5 and 6, a fluid flow demand 23 of 2% of the maximum fluid flow of the hydraulic pump 1 is shown.

As can be seen from FIG. 5, according to the previously known method, the accumulator 14 sums up the 2% demand 11. This will continue for eight decision points (i.e. eight times a 60° movement of the rotable shaft 4). Here, the accumulator 14 finally reaches 16%. Therefore, a 16% part-stroke pumping cycle will be initiated. This can be seen from the overall pumping output curve 25. This pumping output 25 is considered via the feedback signal line 13 and decreases the value of the accumulator 14 accordingly. After the part-stroke pumping, the accumulator 14 will again slowly build up, until another part-stroke pumping is initiated. As can be seen from FIG. 5, the time interval between two pumping strokes is quite large.

This is much better with the suggested variable part stroke pumping, which is illustrated in FIG. 6. Here, the 2% value of the accumulator 14 will trigger a 2% part-stroke pumping. The output flow is therefore a series of identical small volume pulses. As it can be clearly seen from FIGS. 5 and 6, using the variable part-stroke mode, the pressure pulses will be much smaller. Also, the response time will be faster.

Figure 7:
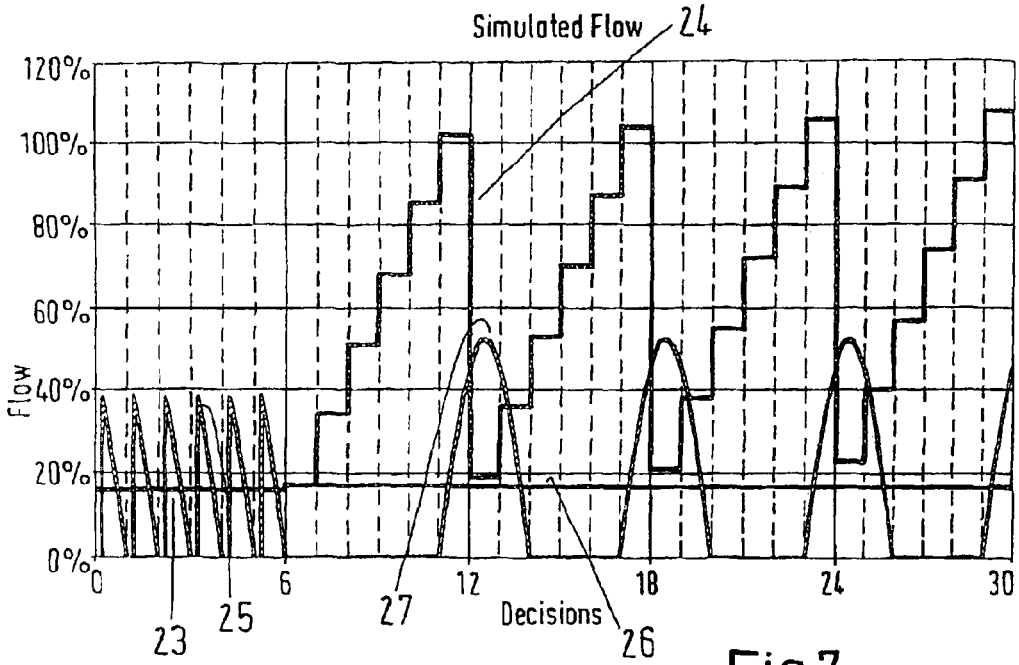
FIG. 7: shows visualisation of the pumping behaviour of a synthetically commutated hydraulic pump according to the state of the art at elevated fluid flow demands.
Figure 8:
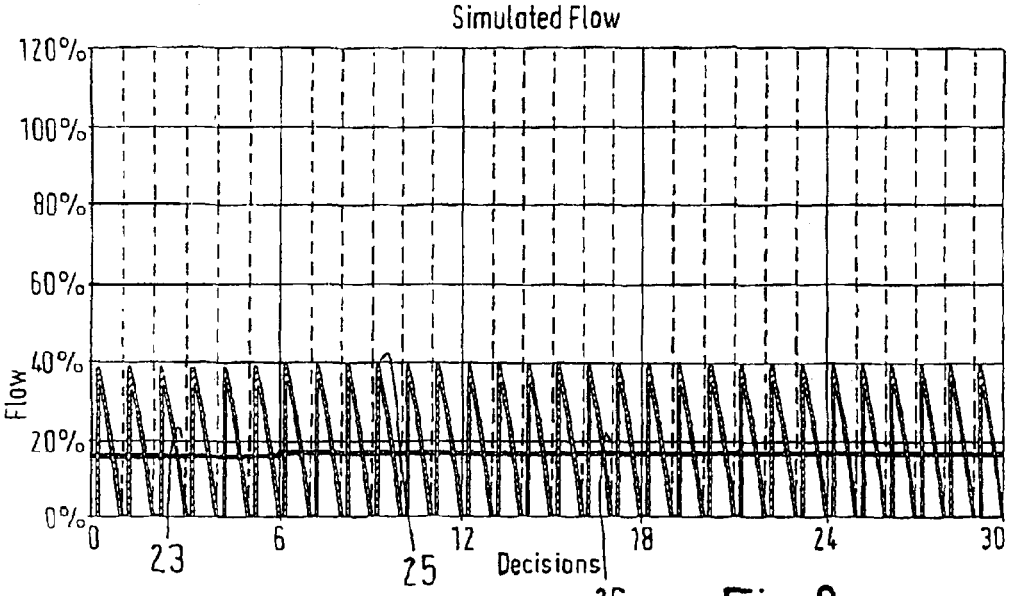
FIG. 8: shows visualisation of the pumping behaviour of a synthetically commutated hydraulic pump using variable part stroke control at elevated fluid flow demands.

FIGS. 7 and 8 show a change from a 16% demand to a 17% demand.

In FIG. 7, the behaviour of a synthetically commutated hydraulic pump, having a part-stroke mode with a fixed part-stroke fraction of 16% is shown. In the first six decision points (one tick equals a 60° rotation of the rotatable shaft), shown in FIG. 7, the fluid flow demand 23 equals 16%. This is equivalent to the volume fraction of the part stroke volume. Therefore, one part-stroke pumping cycle is initiated at each decision point. This way, the accumulator 24 remains constant and equals the demand 23. The situation changes, when the demand increases slightly above the volume fraction of the part-stroke volume. In the example of FIG. 7, the demand is increased to a slightly higher demand 26 of 17%. Now, the part-stroke mode is inhibited, because the elevated demand 26 is higher than the volume fraction of the part-stroke mode. Consequently, the demand causes the accumulator 24 to increase step by step, until the accumulator 24 reaches the 100% threshold. Then a full-stroke cycle 27 is performed. The accumulator 24 drops accordingly and builds up again, until the 100% threshold is reached again and another full-stroke cycle is initiated. As can be seen from FIG. 7, at an elevated demand 26 of 17%, the time intervals between neighbouring pulses are significant and a strong outflow pulsation occurs. It should be noted, that a continuation of part stroke pulses with 16% volume fraction would even worsen the situation. This is, because the basic load would be mostly covered by part-stroke pulses and the accumulator 24 would therefore require an even longer time, until it reaches the threshold for a full stroke cycle 27 to be initiated.

With the variable part stroke method (FIG. 8), however, the differences when jumping from the 16% demand 23 to the 17% increased demand 26 are almost negligible. The only difference is, that the variable part stroke cycle will actuate the electrically actuated valve 8 a little bit earlier, so that a higher fraction is pumped.

Figure 9:
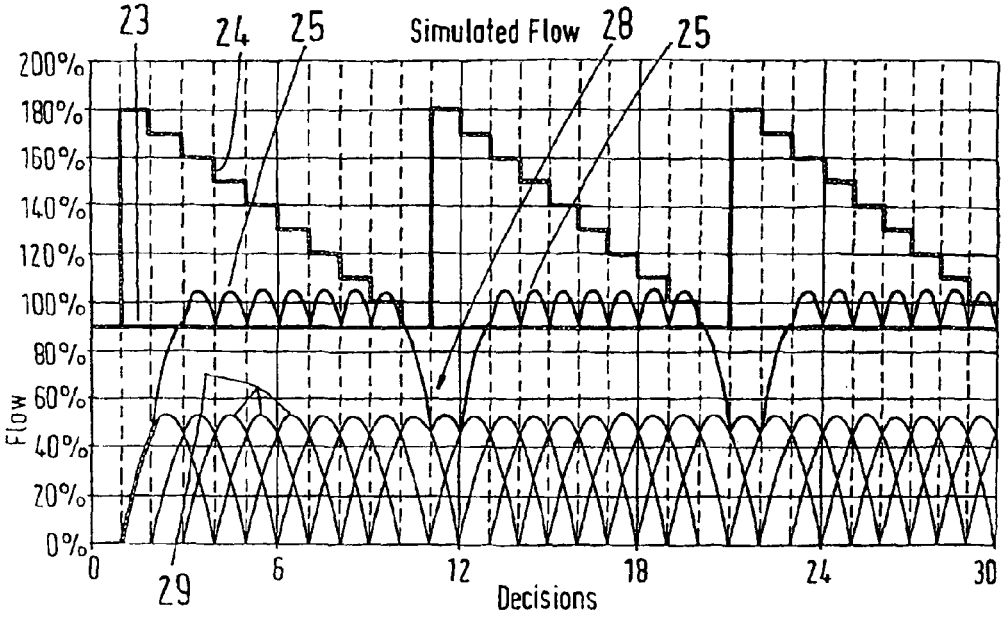
FIG. 9: shows visualisation of the pumping behaviour of a synthetically commutated hydraulic pump according to the state of the art at high fluid flow demands.
Figure 10:
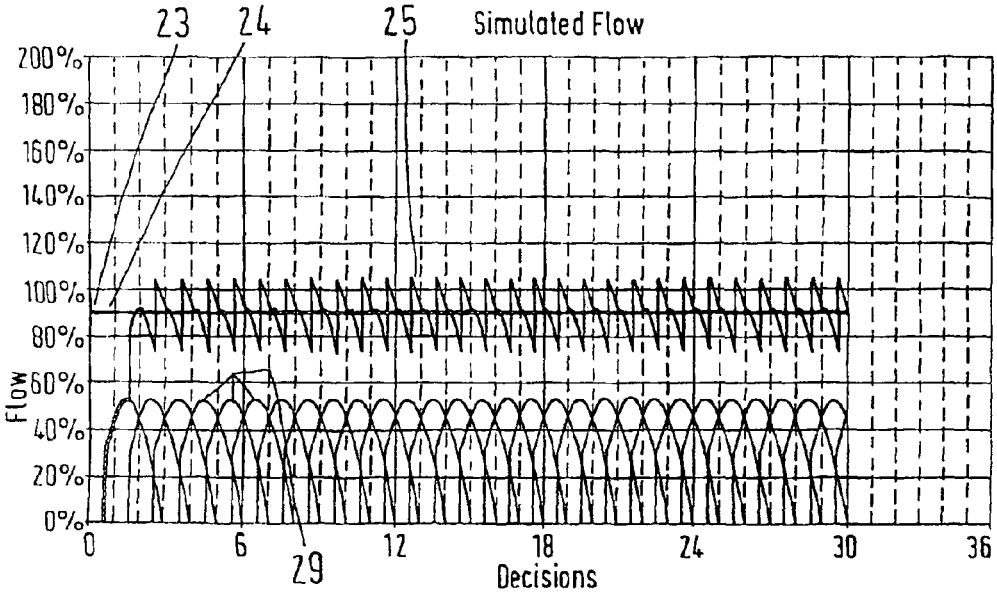
FIG. 10: shows visualisation of the pumping behaviour of a synthetically commutated hydraulic pump using variable part stroke control at high fluid flow demands.

In FIGS. 9 and 10, the output characteristics of the fixed part stroke method and the variable part stroke method are compared to each other, when the demand 23 is set to 90%.

As can be seen from FIG. 9, using the fixed part stroke method, the individual pumping strokes 29 of the single cylinders add up to a total output flow 25. Because the accumulator is decreased slightly during each decision, at some point (in FIG. 9 at decision point 11 and 21) eventually a single stroke will be missing (idle stroke). Therefore, the output flow 25 will show a ditch 28, occurring every 10 cycles.

As can be seen from FIG. 10, with the variable part stroke method, the single pumping strokes 29 are chosen in a way, that the pumped fraction amounts to 90%, which is exactly equal to the demand 23. Therefore, no single pumping stroke will be omitted, and therefore, the total output flow 25 will show no ditch 28, i.e. will be more homogeneous.

As already mentioned, according to a preferred embodiment of the invention, the variable part stroke method may comprise a "forbidden interval" in various situations, as described. Because of the sinusoidal motion of the pistons 6 within the cylinder portion 5 of each cylinder 3, the fluid speed of the hydraulic oil flowing around the opened valve heads of the inlet valve 8 varies in a sinusoidal way as well.

It has been found, that at higher fluid speeds, the actuation of the inlet valve 8 might cause a noisy behaviour of the synthetically commutated hydraulic pump 1. Also, because of the high fluid speeds, a higher wear might occur, when the electrically actuated valve 8 is closed at high fluid speeds.

While the size of the "forbidden interval" to be chosen depends on the actual application, let's assume for the following discussion, that the forbidden interval lies between 25% and 75%.

Figure 11:
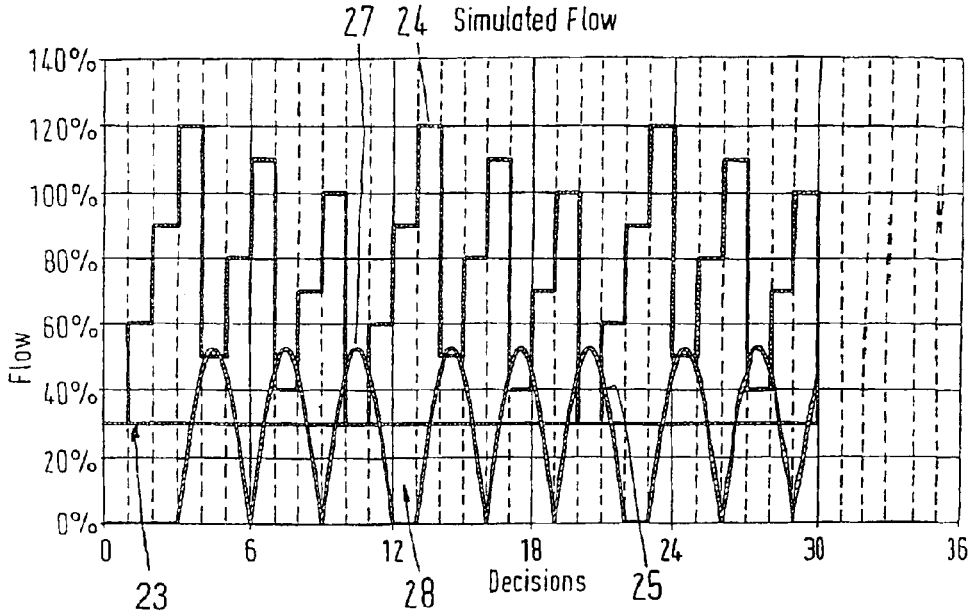
FIG. 11: shows visualisation of the pumping behaviour of a synthetically commutated hydraulic pump according to the state of the art for a fluid flow demand from the "forbidden interval"
Figure 12:
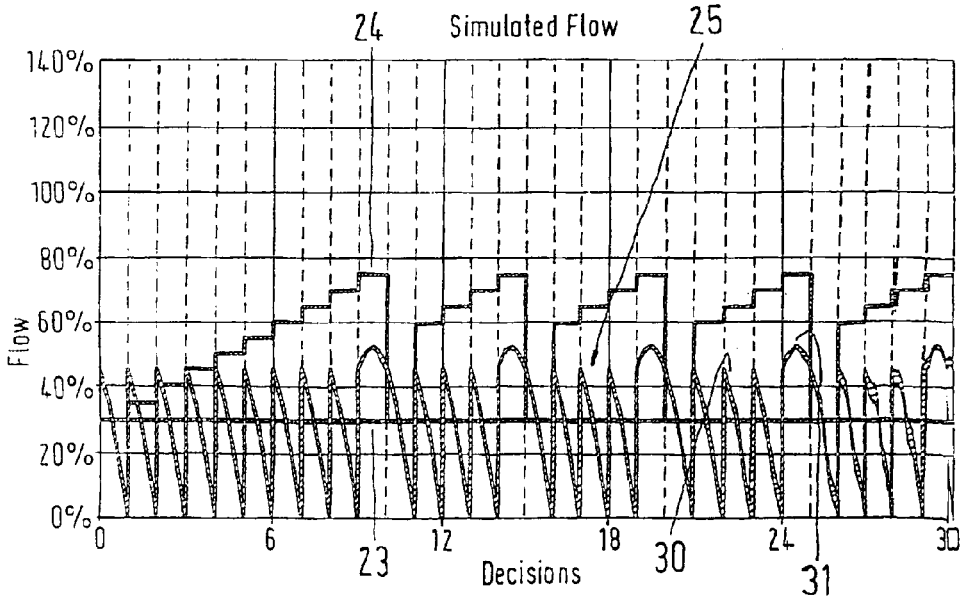
FIG. 12: shows visualisation of the pumping behaviour of a synthetically commutated hydraulic pump using variable part stroke control with the fluid flow demand from the "forbidden area".

As can be seen from FIGS. 11 and 12, even then the variable part stroke method can be superior to the fixed part stroke pumping method. In both FIGS. 11 and 12, the demand 23 is chosen to be 30%.

In FIG. 7, the accumulator 24 builds up until a single full stroke cycle is initiated. As can be seen from FIG. 11, a series of three full stroke cycles 27 with a gap 28 in-between each series is performed.

When using the variable part stroke method, the fluid flow output 25 is much more homogeneous. With the example of a 30% fluid flow demand 23, the method will lock in with groups of four strokes, wherein each group shows three small strokes 30 (at 25% volume fraction) and one large stroke 31 (with 75% volume fraction).

To further illustrate the behaviour of the accumulator and the resulting pumping cycle, tables 1 and 2 are added. Table 1 shows the numerical values of the curves, shown in FIG. 11, while Table 2 shows the numerical development of the curves, shown in FIG. 12.

It can be seen from table 2, that at decision point 10, no pumping (i.e. no 25% volume fraction pumping) is performed, although the accumulator has a value of 30%, and is therefore larger than 25%. This is, because the cylinder, performing the 75% volume fraction pumping cycle at decision point 9, has not completed its pumping cycle before reaching decision point 11. Therefore, this cylinder is not available for (additional) pumping at decision point 10. In other words, although there is a numerical demand for a 25% stroke cycle, no pumping can be performed due to physical reasons.

The value of the interval for the allowed pumping fractions of the part stroke pulses can be dependent on the actual speed of the fluid, leaving the working chamber 7, as well. This decision on fluid speed instead of the firing angle is normally advantageous, in that it links the problem with the real course. The fluid speed can be determined by the shaft speed of the fluid working machine and the angular position of shaft 4. Of course, this method can be implemented in a way, that the limiting value of the firing angle is chosen to be a function of the shaft speed of the fluid working machine.

Additional information can be drawn from the other three applications, filed on the same day by the same applicant under EP Application Serial No. 07254332.5, EP Application Serial No. 07254331.7 and EP Application Serial No. 07254333.3. The contents of said applications are included into the disclosure of this application by reference. Also, U.S. application Ser. No. 12/261,390 is incorporated by reference herein.

TABLE 1

| Decision point | Flow Demand | Accumulator | Decision | Updated Accumulator |
|---|---|---|---|---|
| 0 | 30% | 0% + 30% = 30% | 30% < 100% => vacant cycle | 30% − 0% = 30% |
| 1 | 30% | 30% + 30% = 60% | 60% < 100% => vacant cycle | 60% − 0% = 60% |
| 2 | 30% | 60% + 30% = 90% | 90% < 100% => vacant cycle | 90% − 0% = 90% |
| 3 | 30% | 90% + 30% = 120% | 120% ≧ 100% => full cycle | 120% − 100% = 20% |
| 4 | 30% | 20% + 30% = 50% | 50% < 100% => vacant cycle | 50% − 0% = 50% |
| 5 | 30% | 50% + 30% = 80% | 80% < 100% => vacant cycle | 80% − 0% = 80% |
| 6 | 30% | 80% + 30% = 110% | 110% ≧ 100% => full cycle | 110% − 100% = 10% |
| 7 | 30% | 10% + 30% = 40% | 40% < 100% => vacant cycle | 40% − 0% = 40% |

TABLE 2

| Decision point (. . .) | Flow Demand | Accumulator | Decision | Updated Accumulator |
|---|---|---|---|---|
| 6 | 30% | 30% + 30% = 60% | 25% ≦ 60% < 75% => 25% stroke cycle | 60% − 25% = 35% |
| 7 | 30% | 35% + 30% = 65% | 25% ≦ 65% < 75% => 25% stroke cycle | 65% − 25% = 40% |
| 8 | 30% | 40% + 30% = 70% | 25% ≦ 70% < 75% => 25% stroke cycle | 70% − 25% = 45% |
| 9 | 30% | 45% + 30% = 75% | 75% ≦ 75% => 75% stroke cycle | 75% − 75% = 0% |
| 10 | 30% | 0% + 30% = 30% | 25% ≦ 30% < 75% => 0% stroke cycle | 30% − 0% = 30% |
| 11 | 30% | 30% + 30% = 60% | 25% ≦ 60% < 75% => 25% stroke cycle | 60% − 25% = 35% |

While the present invention has been illustrated and described with respect to a particular embodiment thereof, it should be appreciated by those of ordinary skill in the art that various modifications to this invention may be made without departing from the spirit and scope of the present.

What is claimed is:

1. A method of operating a fluid working machine, comprising at least one working chamber of cyclically changing volume, a high pressure fluid connection, a low pressure fluid connection and at least one electrically actuated valve, connecting said working chamber to said high pressure fluid connection and/or said low pressure fluid connection, wherein the timing of the actuation of said electrically actuated valve is varied depending on the fluid flow demand.

2. The method according to claim 1, wherein the timing of the actuation of said electrically actuated valve is varied depending on the mechanical power demand.

3. The method according to claim 1, wherein at least a pumping motoring fraction between 0% and 33.3% of the maximum pumping/motoring volume of said working chamber is chosen.

4. The method according to claim 1, wherein at least a Pumping/motoring fraction between 66.7% and 100% of the maximum Pumping/motoring volume of said working chamber is chosen.

5. The method according to claim 1, wherein a pumping/motoring fraction between 33.3% and 66.7% of the maximum pumping/motoring volume of said working chamber is excluded.

6. The method according to claim 1, wherein a plurality of different pumping/motoring fractions of a plurality of working chambers and/or a plurality of different pumping/motoring strokes of at least one working chamber are combined in a way, that the time averaged effective pumping/motoring fraction is adjusted to satisfy the fluid flow demand.

7. The method according to claim 1, wherein at least one calibration point is used for deriving the pumping/motoring actuation angle from the fluid flow demand.

8. The method according to claim 1, wherein a mathematical function is used for deriving the pumping/motoring actuation angle from the fluid flow demand.

9. A fluid flow machine, comprising at least one working chamber of cyclically changing volume, a high pressure fluid connection, a low pressure fluid connection, at least one electrically actuated valve, connecting said working chamber to said high pressure fluid connection and/or said low pressure fluid connection and at least one electronic controller unit, characterised in that said electronic controller unit is designed and arranged in a way, that the electronic controller unit actuates said electrically actuated valve according to claim 1.

10. A method of operating a fluid working machine, comprising at least one working chamber of cyclically changing volume, a high pressure fluid connection, a low pressure fluid connection and at least one electrically actuated valve, connecting said working chamber to said high pressure fluid connection and/or said low pressure fluid connection, wherein the timing of the actuation of said electrically actuated valve is varied depending on the fluid flow demand, wherein the timing of the actuation of said electrically actuated valve is varied depending on the mechanical power demand.

11. The method according to claim 10, wherein at least a pumping motoring fraction between 0% and 33.3% of the maximum pumping/motoring volume of said working chamber is chosen.

12. The method according to claim 10, wherein at least a pumping motoring fraction between 66.7% and 100% of the maximum pumping/motoring volume of said working chamber is chosen.

13. The method according to claim 10, wherein a pumping/motoring fraction between 33.3% and 66.7% of the maximum pumping/motoring volume of said working chamber is excluded.

14. The method according to claim 10, wherein a plurality of different pumping motoring fractions of a plurality of working chambers and/or a plurality of different pumping/motoring strokes of at least one working chamber are combined in a way, that the time averaged effective pumping/motoring fraction is adjusted to satisfy the fluid flow demand.

15. The method according to claim 10, wherein at least one calibration point is used for deriving the pumping/motoring actuation angle from the fluid flow demand.

16. The method according to claim 10, wherein a mathematical function is used for deriving the pumping/motoring actuation angle from the fluid flow demand.

17. A fluid flow machine, comprising at least one working chamber of cyclically changing volume, a high pressure fluid connection, a low pressure fluid connection, at least one electrically actuated valve, connecting said working chamber to said high pressure fluid connection and/or said low pressure fluid connection and at least one electronic controller unit, characterised in that said electronic controller unit is designed and arranged in a way, that the electronic controller unit actuates said electrically actuated valve according to claim 10.

* * * * *